United States Patent [19]

Nowakowski

[11] 4,399,849

[45] Aug. 23, 1983

[54] QUALITY CONTROL PROCESS

[76] Inventor: Karol L. Nowakowski, P.O. Box 1054, Bend, Oreg. 97709

[21] Appl. No.: 281,604

[22] Filed: Jul. 9, 1981

[51] Int. Cl.[3] ..... B27M 1/00

[52] U.S. Cl. ..... 144/364; 83/71; 83/358; 101/426; 106/20; 134/29; 144/3 N; 144/356

[58] Field of Search ..... 144/2 R, 3 N, 356, 379, 144/364; 101/426; 106/20, 21; 134/29; 83/71, 358, 359

[56] References Cited

U.S. PATENT DOCUMENTS

| | | | |
|---|---|---|---|
| 2,086,745 | 7/1937 | Sell . | |
| 2,089,413 | 8/1937 | Paine et al. . | |
| 2,137,463 | 11/1938 | Shields . | |
| 2,161,205 | 6/1939 | Shields . | |
| 2,228,033 | 1/1941 | Martone . | |
| 3,360,337 | 12/1967 | Edenbaum et al. . | |
| 3,780,777 | 12/1973 | Davies | 144/3 N |
| 3,848,646 | 11/1974 | Miles | 144/3 N |
| 3,955,502 | 5/1976 | von Hofe . | |
| 4,070,194 | 1/1978 | Arakowa . | |
| 4,283,975 | 8/1981 | Knoll | 83/71 |

*Primary Examiner*—W. D. Bray

*Attorney, Agent, or Firm*—Klarquist, Sparkman, Campbell, Leigh, Whinston & Dellett

[57] ABSTRACT

The invention provides a quality control process for lumber-cutting operations. It normally includes the following steps: (1) treating, with a normally invisible indicator, a portion of the lumber to be cut; (2) recording the physical properties of the portion of lumber; (3) commingling the treated, recorded portion with the remainder of the lumber; (4) performing cutting operations on the lumber; (5) imposing conditions on the lumber that will render the indicator visible on the treated portion; and (6) comparing the cut pieces of the treated, recorded portion with the precut record to determine the efficiency of the cutting operations.

6 Claims, 2 Drawing Figures

QUALITY CONTROL PROCESS

BACKGROUND OF THE INVENTION

1. Field of the Invention

This invention relates generally to a quality control process and more particularly to a quality control process for use in lumber-cutting operations.

2. Description of the Prior Art

In sawmill operations it is customary to first debark a raw log, then saw or rip the log in a lengthwise direction into the desired board sizes, and finally to transversely crosscut the board into shortened lengths where necessary to remove defects in the board. This crosscutting operation is typically performed last, since the defects may not be visible until the final longitudinal rip is performed.

The crosscutting operation is critical since it is essential that all substantial defects in the board be removed; yet, it is also essential that the longest lengths possible be left for sale. In order to be able to produce optimum board lengths, the sawyer must be intimately familiar with the type of board defects which will have an adverse effect upon the appearance and/or performance of the boards. Defects, such as wane edges, blue stain, pitch seams, knotholes, cross grain, and rot or incipient decay, must almost always be removed. The sawyer's utmost attention and skill is necessary in order to make the correct determination as to which defects should be removed, and precisely the way in which they should be removed, so that the highest possible percentage of the board is retained.

In the past, it has been difficult to monitor and evaluate the work of a sawyer. This is due to the fact that there normally are several such sawyers working in any particular lumber cutting operation; so there is no way of evaluating, from the commingled pieces of lumber, the quality of cuts made by any particular sawyer. The use of an observer is expensive and ineffective, since the operator is normally aware of the observance and therefore often has a tendency to perform the work with an artificially high degree of skill and conscientiousness for the length of time observed. Permanent observation would be cost prohibitive.

A second method which might be used to qualitatively evaluate the work of the sawyers is to provide the saws of each of the sawyers with a distinctive stamp which identifies each piece of wood which is cut with the saw. This at least theoretically makes it possible to determine the quantity of work being done by a sawyer. However, qualitative analysis is impractical because by the time the boards from a particular sawyer are capable of collection, they are normally commingled with many other boards also cut by the same sawyer. Thus, it would be exceedingly difficult and clearly uneconomical to reassemble the boards to effectively determine the efficiency of the lumber-cutting operations.

A different approach which has been taken to optimize the efficiency of defect removal has been to remove the human element entirely by utilizing a computer which scans the boards with a laser. Since defects have a greater than normal tendency to reflect the laser, identification of defects is possible. Such systems have not been totally satisfactory because some critical defects are of the type that do not return laser light in sufficient quantities to be recognized by the system. Also, superficial dirt or similar markings on the wood may appear as defects to the laser scanner. This results in unnecessary cuts being taken, which could have a substantial effect upon the efficiency of the lumber-cutting operation. Even if it is assumed that such technical problems will be overcome in the future, the cost of this type of system is likely to continue to be very high, well beyond the means of smaller operators.

Hence, it is a primary object of the present invention to provide an improved quality control process which effectively and reliably overcomes the aforementioned limitations and drawbacks of the prior art proposals. More specifically, the present invention has as its objects one or more of the following, taken individually or in combination:

(1) To provide a process for quality control in lumber-cutting operations in which the sawyer can be monitored without his knowledge, thereby providing an accurate indication of the quality of work being performed;

(2) The provision of quality control process which can be economically implemented on a periodic basis without interrupting commercial operations;

(3) To provide a process in which the work of lumber-cutting personnel can be evaluated which does not require complex equipment or extensive training of personnel and which is readily adaptable to conventional lumber-cutting operations; and (4) To develop a quality control process which will improve the efficiency of a lumber-cutting operation, thereby increasing profits and/or lowering prices, while at the same time conserving valuable natural resources.

SUMMARY OF THE INVENTION

The invention responds to the problems presented in the prior art by providing a quality control process for lumber-cutting operations. The process includes the following steps: (1) treating lumber to be cut with a normally invisible indicator; (2) recording the physical properties of the lumber to be cut; (3) cutting the lumber; (4) rendering the indicator visible on the treated, recorded lumber; and (5) comparing the cut, treated lumber with the recorded physical properties to determine the efficiency of the cutting operations.

More particularly, the process normally includes the following steps: (1) treating, with a normally invisible indicator, a portion of the lumber to be cut; (2) recording the physical properties of the portion of lumber; (3) commingling the treated, recorded portion with the remainder of the lumber; (4) performing cutting operations on the lumber; (5) rendering the indicator visible on the treated, recorded portion; and (6) comparing the cut pieces of the treated, recorded portion with the recorded physical properties to determine the efficiency of the cutting operations. The treating and recording steps may be performed in either order, but the remainder of the steps must be performed subsequently.

The treating step normally includes applying a first aqueous solution which first solution is normally invisible, and the step of rendering the indicator visible normally comprises applying a second aqueous solution to the treated, recorded lumber, which solution renders the first solution visible. The treating step may, instead of the above-described applications, include the step of applying a normally invisible, ultraviolet sensitive substance. When such a substance is used, the step of rendering the indicator visible comprises subjecting the lumber to ultraviolet light, thereby rendering the ultraviolet sensitive substance visible.

The invention provides a method of accurately evaluating the efficiency of the cutting operations of a particular sawyer, under actual operating conditions. In the event that substandard work is being done, the sawyer may be given remedial instruction which would improve his work and thereby increase the output of the operation.

The invention will be understood and objects other than those set forth above will become apparent when consideration is given to the following detailed description thereof. Such description makes reference to the annexed drawings in which:

FIG. 1 is a schematic representation of a first embodiment of the present invention; and FIG. 2 is a schematic representation of a second embodiment of the present invention.

DETAILED DESCRIPTION OF THE PREFERRED EMBODIMENTS

First Embodiment

Figure 1:
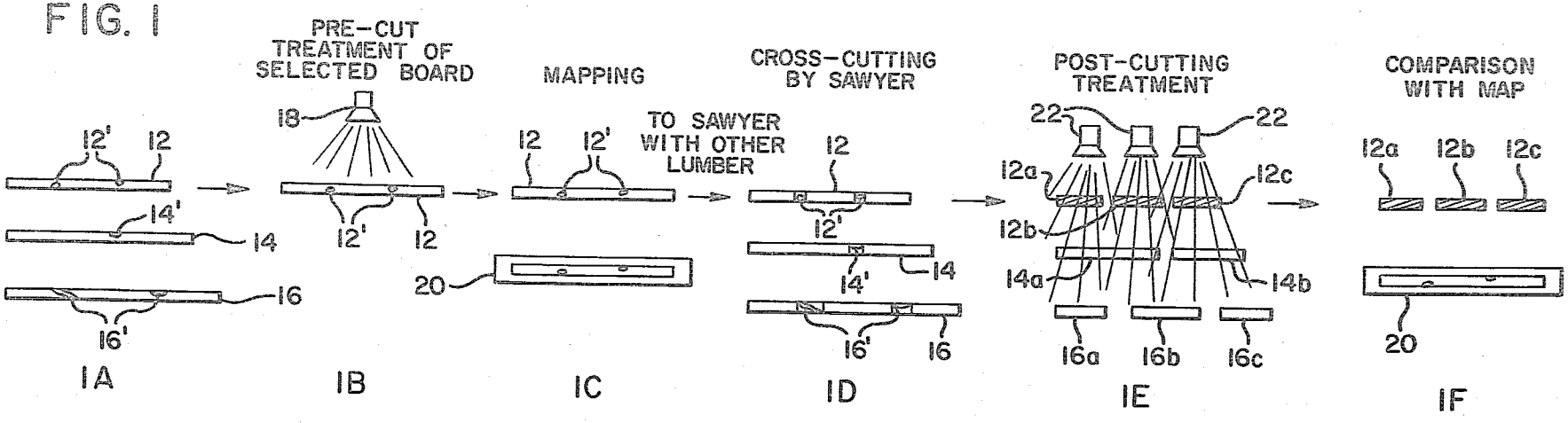

A first embodiment of the present invention is schematically depicted in FIG. 1. The schematic depiction of FIG. 1 includes six operating stations, identified as 1A, 1B, 1C, 1D, 1E, and 1F, where various operations are performed on boards which have been cut from a log. Through these various operations, the performance of a sawyer engaged in cutting out defects in the boards can be evaluated. The term "board" has been used because the lumber handled by this process is normally in a substantially planar, boardlike configuration. However, "board" as used herein is intended to encompass posts and other lumber pieces which may not be substantially planar in configuration. Defects in boards, such as wane edges, blue stain, pitch seams, knotholes, cross grains, and rot or incipient decay, are sometimes removed by performing longitudinal cuts or rips, but since most defects are removed by crosscutting, the emphasis in this detailed description will be on crosscutting. However, the invention is applicable to any type of cutting operation which removes the defects from the lumber.

A multiplicity of boards are fed to each of the sawyers in the crosscutting area of a cut shop. These boards are schematically represented by boards 12, 14, and 16 at operating station 1A. Each of these boards is depicted with at least one defect 12', 14', and 16', which must be removed by the sawyer.

One of the boards, here board 12, is selected from boards 12, 14, and 16 being conveyed to a particular sawyer. This selected board 12 is then sprayed at operating station 1B by a nozzle 18 or is otherwise coated with an aqueous solution which is invisible once it is dry on the board. The physical properties of the treated board 12 are then recorded or mapped through a conventional mapping procedure at operating station 1C. A schematic map representation of board 12 is shown at 20.

The treated, mapped board 12 is then commingled with other lumber going to the sawyer so that the sawyer is unaware that any boards have been pretreated or that there is any monitoring taking place whatsoever. The sawyer then cuts out defects 12', 14', and 16'in boards 12, 14, and 16 at operating station 1D. During this cutting operation, the sawyer must consider how to get the highest value and least waste possible out of each board cut. For example, a crosscutter must consider if a high-value solid doorjamb can be cut from a board by leaving in an allowable defect, or, if the defect must be cut out, whether a shorter intermediate-valued cut can be made for a windowsill or the like without creating excessive waste. Similar decisions are needed in sawmill operations for crosscut and/or ripping wood into low or high value two-by-fours versus two-by-eights, four-by-fours, or assorted other beam sizes, lengths, and grades. Likewise, in furniture manufacturing, the same decisions are required in crosscutting and/or ripping operations to get the highest value and least waste out of each piece cut for furniture parts.

Once the defects have been removed by the sawyer, all of the boards which have been cut in a particular time period are sprayed with a second aqueous solution through nozzles 22 at operating station 1E. This renders the first solution visible on pieces **12*a*, 12*b*, and 12*c* of board 12. These pieces can then be compared with map 20 at operating station 1F** to evaluate the efficiency of the crosscutting being performed by the sawyer.

Typical Indicators Used With First Embodiment

As discussed above, the first embodiment of the invention involves an initial treatment of board 12 with a normally invisible indicator and a second, postcut treatment with a second solution which will render the first solution visible. Any number of conventional indicators may be used for these first and second solutions. For example, various phthalein complexes may be utilized for the first solution, with an alkali solution being used for the second solution. It is well known that many phthalein complexes will be invisible until combined with an alkali solution which will change the pH of the phthalein, thereby rendering it visible. The concentration of the phthalein complexes and the alkalies can be varied depending upon the intensity of the desired color and upon the quantity of alkali residue which is tolerable. Of course, since an entire sampling of boards is sprayed with the alkali, it is desirable that a minimal amount be utilized in order to keep expenses down and to minimize any undesirable markings or coatings upon the boards.

The preferred first solution comprises a four percent phenolphthalein solution (by weight) mixed in a 70 percent alcohol (isopropyl) solution. When this first solution is applied to the wood surface and allowed to dry, it is invisible. To render this first solution visible, an alkali solution, preferably sodium carbonate at a concentrate of 0.25 normal in water, is utilized. Alternatively, it is possible to use other phthaleins, such as thymolphthalein or cresolphthalein, also at a four percent concentration instead of phenolphthalein. Regardless of the phthalein used, a sodium hydroxide solution may be substituted for sodium carbonate.

It may be desirable in certain applications to utilize a lead nitrate solution in place of the phthalein as the first solution. An appropriate lead nitrate solution is prepared by dissolving 1.0 gram of lead nitrate per 2.0 milliliter of cold water. The solution will appear a dilute milky white, but when applied over the board surfaces and permitted to dry, it will be invisible. In order to render the lead nitrate solution visible, a potassium iodide solution (four percent by weight) is applied. The application of this solution to the board which has been previously treated with lead nitrate will turn the board a bright yellow color.

Second Embodiment

Figure 2:
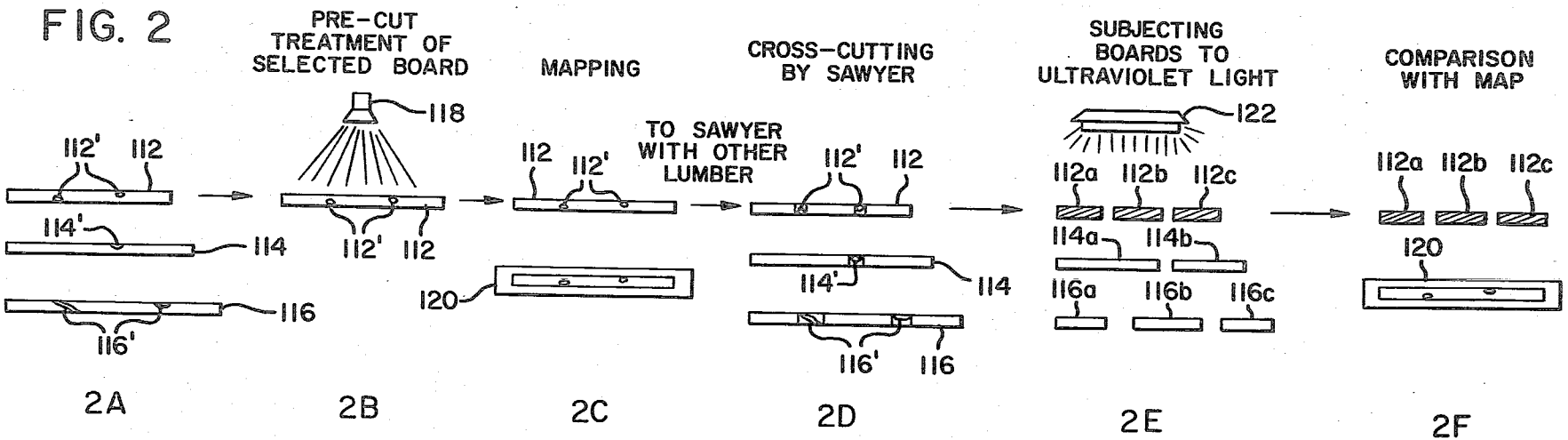

A second embodiment of the present invention is schematically depicted in FIG. 2. Like FIG. 1, FIG. 2 also includes six operating stations, identified as 2A, 2B, 2C, 2D, 2E, and 2F. This second embodiment is quite similar to the first embodiment, and therefore corresponding numerals have been used to identify the components of the second embodiment, except that numerals are in the 100 series. Thus, the boards are identified at station 2A with the numerals 112, 114, and 116, with their respective defects noted at 112', 114', and 116'. The basic difference between the first and second embodiments is that the first solution of the second embodiment comprises a solution which will be invisible under white light but visible under long-wave ultraviolet light. This type of solution is commercially available and would typically be a zinc sulfide-based fluorescent compound.

As schematically depicted at operating station 2B, a selected board 112 is sprayed with a fluorescent first solution via nozzle 118. The physical characteristics of the board are then mapped on map 120 at operating station 2C, after which board 112 is commingled with the other boards going to the sawyer. The sawyer then crosscuts the defects 112', 114', and 116' out of boards 112, 114, and 116 at operating station 2D, exercising judgment as to which defects must be removed to render the boards suitable for a particular end use. The board pieces 112*a*, 112*b*, 112*c*, 114*a*, 114*b*, 116*a*, 116*b*, and 116*c* cut by the sawyer are then subjected to ultraviolet light at operating station 2E by lamp 122 so that pieces 112*a*, 112*b*, and 112*c*, which were previously treated with the ultraviolet-sensitive solution, will stand out. Pieces 112*a*, 112*b*, and 112*c* are then removed from the batch of boards, and a comparision is made with map 120 at operating station 2F to evaluate the cutting decisions made by the sawyer.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A quality control process for lumber-cutting operations comprising:

treating lumber to be cut with a normally invisible indicator;

recording the physical properties of the lumber to be cut;

cutting the lumber;

rendering the indicator visible on the treated, recorded lumber; and comparing the cut, treated lumber with the recorded physical properties to determine the efficiency of the cutting operations.

2. A quality control process for lumber-cutting operations, wherein the process comprises:

treating, with a normally invisible indicator, a portion of the lumber to be cut;

recording the physical properties of the portion of lumber;

commingling the treated, recorded portion with the remainder of the lumber;

performing cutting operations on the lumber;

rendering the indicator visible on the treated, recorded portion;

comparing the cut pieces of the treated, recorded portion with the recorded physical properties to determine the efficiency of the cutting operations.

3. The process of claim 1 or 2 wherein said treating step comprises applying a first aqueous solution, the first solution being normally invisible, and wherein said step of rendering the indicator visible comprises applying a second aqueous solution to the treated, recorded lumber, the second solution being one which renders the first solution visible.

4. The process of claim 3 wherein the first solution is a phthalein solution and the second solution is an alkali solution.

5. The process of claim 3 wherein the first solution is a lead nitrate solution and the second solution is a potassium iodide solution.

6. The process of claim 1 or 2 wherein said treating step comprises applying a normally invisible ultraviolet-sensitive substance, and wherein said step of rendering the indicator visible comprises subjecting the lumber to ultraviolet light to render the ultraviolet-sensitive substance visible.

* * * * *